US006079804A

United States Patent [19]

Draheim

[11] Patent Number: 6,079,804

[45] Date of Patent: Jun. 27, 2000

[54] HUTCH AND CHEST COMBINATION

[75] Inventor: Harvey J. Draheim, Weyauwega, Wis.

[73] Assignee: Simmons Juvenile Products Company, Inc., New London, Wis.

[21] Appl. No.: 09/268,528

[22] Filed: Mar. 12, 1999

[51] Int. Cl.[7] ..... A47B 43/00

[52] U.S. Cl. ..... 312/107; 312/257.1; D6/438; D6/439

[58] Field of Search ..... 312/195, 196, 312/107, 108, 257.1, 237, 235.4, 235.2, 240, 111, 205, 235.1, 281; D6/437, 438, 439, 441, 445, 447; 5/603, 655

[56] References Cited

U.S. PATENT DOCUMENTS

| | | | |
|---|---|---|---|
| D. 23,189 | 4/1894 | Hullhorst | D6/437 |
| D. 104,839 | 6/1937 | Feldman | D6/437 |
| D. 300,888 | 5/1989 | Bush et al. | D6/436 |
| D. 376,279 | 12/1996 | Lenger | D6/438 |
| D. 387,223 | 12/1997 | Brunner et al. | D6/439 |
| 598,742 | 2/1898 | Ostertag | 312/257.1 X |
| 1,690,404 | 11/1928 | Dieckmann | 312/237 X |
| 1,788,883 | 1/1931 | Madsen | 312/107 |
| 2,696,418 | 12/1954 | Bombara | 312/235.2 |
| 3,325,233 | 6/1967 | Oppenhuizen et al. | 312/257.1 X |
| 3,338,648 | 8/1967 | Bannister | 312/196 X |
| 3,389,666 | 6/1968 | Schultze-Bonatz | 312/257.1 X |
| 3,741,450 | 6/1973 | Seastrom | 312/111 X |
| 3,790,241 | 2/1974 | Messina | 312/111 |
| 5,678,905 | 10/1997 | Kelley | 312/196 |
| 5,694,862 | 12/1997 | Grubb | 312/196 X |
| 5,842,758 | 12/1998 | Kelley | 312/223.3 X |

FOREIGN PATENT DOCUMENTS

| | | | |
|---|---|---|---|
| 2703226 | 10/1994 | France | 312/205 |
| 84880 | 4/1916 | Germany | 312/107 |
| 173265 | 12/1952 | Germany | 312/107 |
| 3517605 | 11/1986 | Germany | 312/107 |

*Primary Examiner*—Peter M. Cuomo
*Assistant Examiner*—James O. Hansen
*Attorney, Agent, or Firm*—Hoffmann & Baron, LLP

[57] ABSTRACT

A hutch for use with a chest including multiple sections of different heights. The hutch includes a cabinet having side walls and a rear wall designed for mounting upon the top surfaces of a multi-level chest. It further includes a removable shelf having a length corresponding to the width of one of the sections of the chest. The hutch and chest may be designed to accommodate a changing pad for changing an infant. The pad is replaced by the shelf once the infant has outgrown the pad.

24 Claims, 6 Drawing Sheets

HUTCH AND CHEST COMBINATION

BACKGROUND OF THE INVENTION

1. Field of the Invention

The invention relates to hutches of the type which are used in combination with chests or dressers, and particularly chests or dressers which include multi-level upper surfaces.

2. Brief Description of the Related Art

Chests and dressers are well known furniture items that are typically used for storing articles of apparel. They typically include several drawers which are slidably mounted to a cabinet. The tops of such dressers are flat.

Another type of chest, sometimes referred to as a combo unit, is constructed somewhat differently. Such pieces of furniture include a first section constructed substantially the same as a chest of drawers. In other words, a plurality of slidable drawers, one located over the other, are positioned within a cabinet having a substantially flat top portion. They further include a second section adjoining the first section in a side-by-side manner. The second section includes one or more compartments which may be accessed by drawers and/or hinged doors. In a combo unit, one of the sections is taller than the other, and accordingly has a higher top surface than the other section. One of the sections is also typically wider than the other. The wider section, which is usually the first section, is ordinarily the one with the lower top surface.

In order to increase the storage capacity of a chest, dresser or combo unit, hutches have been designed to rest on the top surface or surfaces thereof. Such hutches are generally comprised of cabinets having shelves. Drawers and doors are generally not provided.

While providing greater storage capacity, conventional hutches do not offer a great deal of flexibility. This is due to the fact that the shelves can only be positioned in fixed positions, or in selected positions which may not be ideal for the user.

In the field of juvenile furniture, the ability to modify furniture as an infant grows is a highly desirable feature. Cribs, for example, are sometimes convertible into youth beds. When combo units are purchased as part of a juvenile furniture set, the top surface of the chest portion of the unit is frequently used to support a changing pad. As the infant grows, such use of the chest portion is discontinued. If a hutch is mounted to the combo unit, it may interfere with the ability to mount a changing pad or to change an infant on the top surface of the chest portion. If it does not interfere with such use, it is unlikely to provide the storage capacity which may be desired once the infant has matured to the point at which the changing pad is no longer used.

SUMMARY OF THE INVENTION

It is an object of the invention to provide a hutch which provides superior versatility when used with a combo unit or the like.

It is another object of the invention to provide a hutch/combo unit assembly which allows the user to modify the hutch in a desirable manner.

A still further object of the invention is to provide an assembly including a hutch, combo unit, changing pad and a removable shelf, wherein the shelf is stored while the changing pad is in use, and the shelf is coupled to the hutch when the changing pad is no longer used.

In accordance with these and other objects of the invention, a hutch is provided which includes a bottomless cabinet having a rear wall, a top wall, first and second opposing side walls, and a front opening. The hutch is designed to be mounted to a combo unit. The side walls thereof are accordingly of different lengths, and the rear wall defines a notched portion for receiving the higher section of the combo unit. A shelf is provided having a length which is substantially equal to the distance between one of the side walls and the notched portion of the rear wall. The shelf is removably securable to the cabinet. If removed, the combo unit to which the hutch is mounted can be used as a changing station as sufficient head room is provided between the top of the lower and preferably wider section of the combo unit and the upper shelf or top of the hutch. Once the changing pad is removed, the shelf can be coupled to the hutch. As the shelf does not extend completely across the hutch, a compartment of sufficient height remains above the taller section of the combo unit.

A hutch/combo unit assembly is further provided by the invention. A hutch substantially as described above is mounted to a chest in the form of a combo unit. The assembly offers superior versatility, and as well as arrays of storage compartments which enhance the utility thereof.

DETAILED DESCRIPTION OF THE INVENTION

Figure 1:
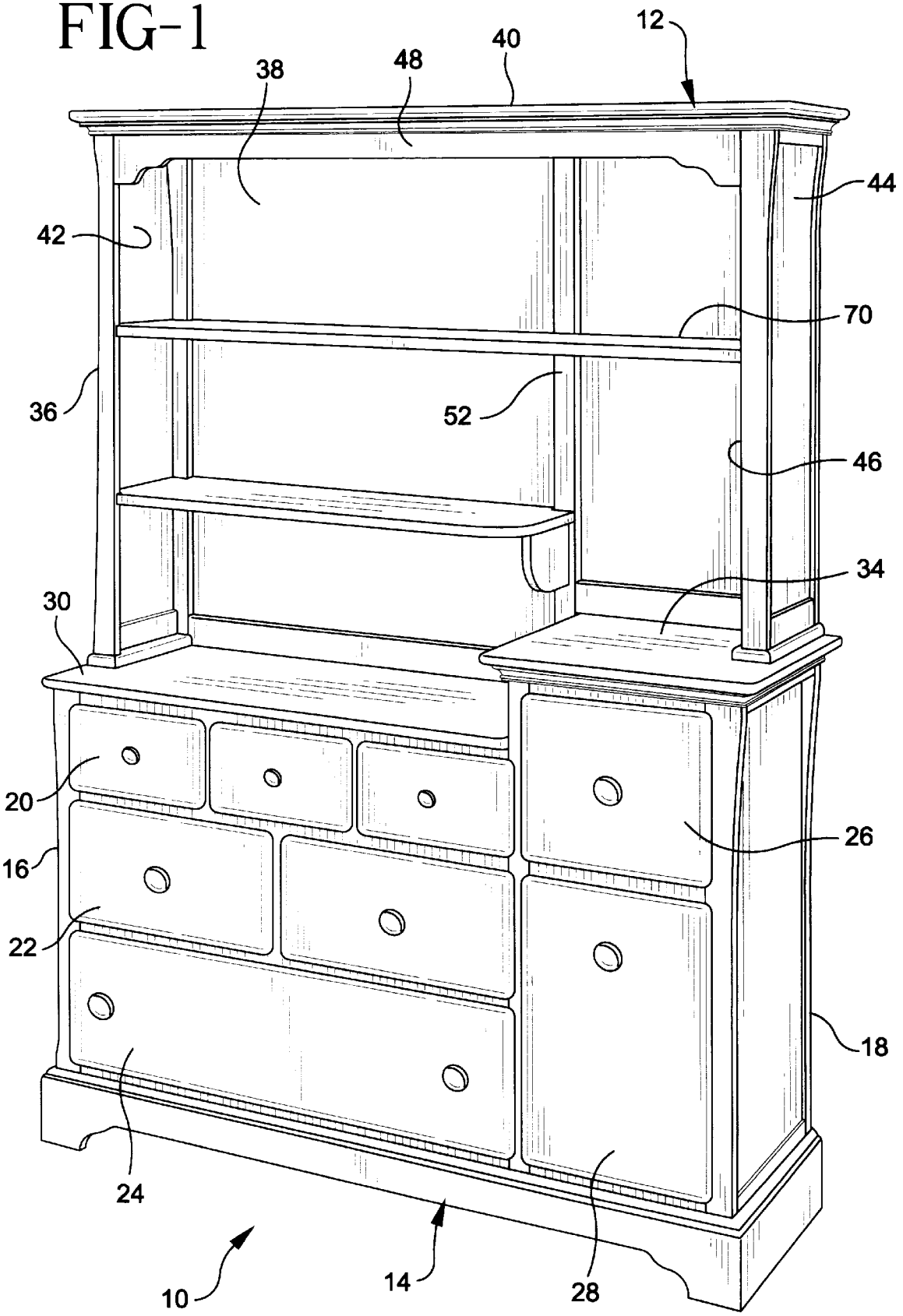
FIG. 1 is a front perspective view of a hutch and chest combination in accordance with the invention.
Figure 2:
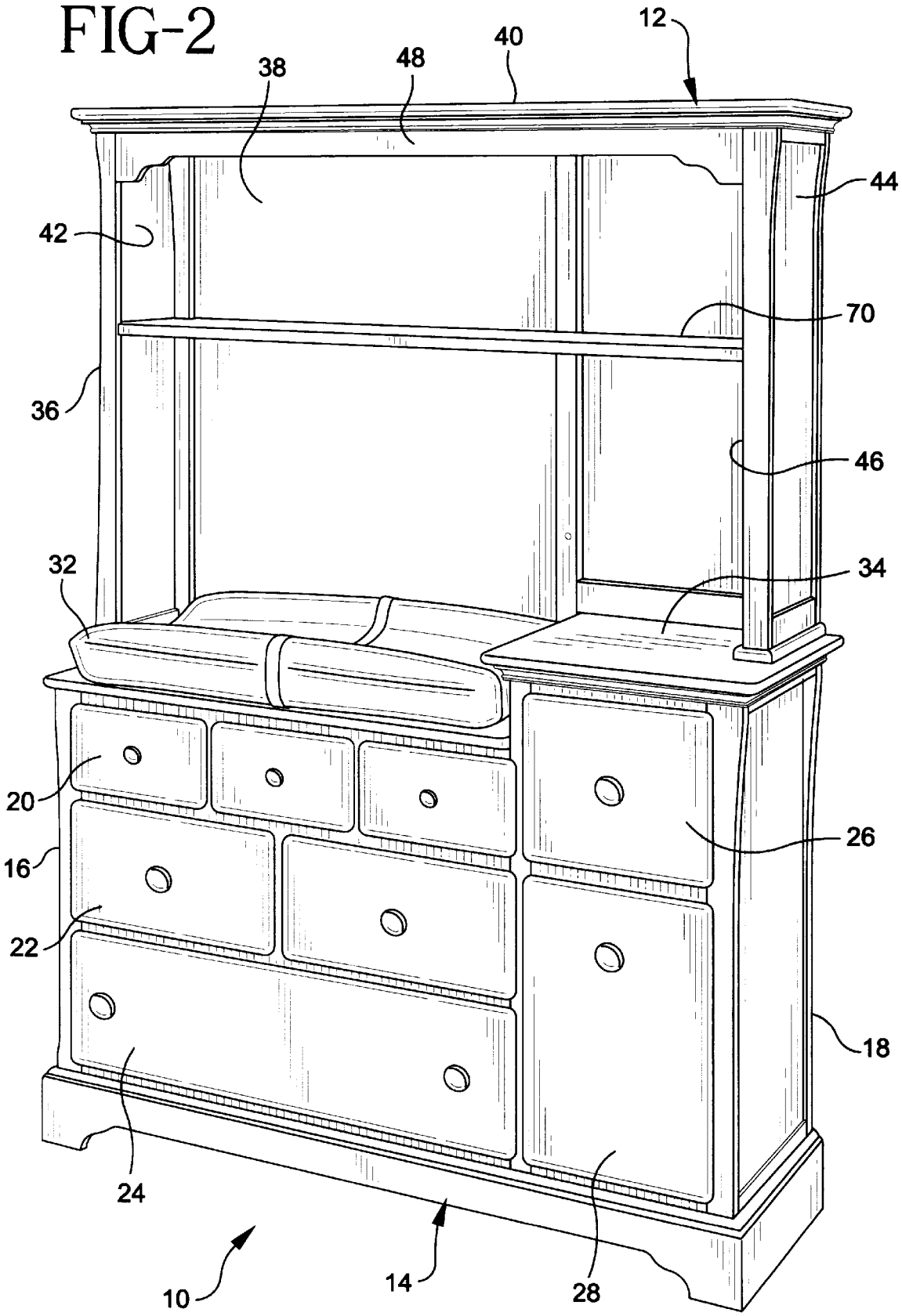
FIG. 2 is a similar view showing a changing pad secured to the chest and a shelf removed from the hutch.

A hutch/combo unit assembly 10 is provided which offers superior versatility, particularly when used as an article of juvenile furniture. The assembly is comprised of a hutch 12 and a chest 14 of the type having a first section 16 of one height and a second, adjoining section 18 of greater height. The first section is preferably wider than the second section, as shown in FIGS. 1–2. It includes a plurality of storage compartments, usually in the form of drawers 20–24. The second section includes one or more storage compartments. These compartments may be in the form of drawers 26, 28, though many combo units provide hinged doors to access the compartments in the second or taller section. The compartments in the second section are typically narrower and taller than those in the first section, which allows the storage of a large variety of items.

The first section 16 of the chest 14 includes a first top surface 30. This surface is preferably of sufficient length and width to accommodate a changing pad 32 removably secured to the chest as shown in FIG. 2. The second section 18 includes a second top surface 34 which is higher than the first top surface 30 and preferably higher than the top surface of the changing pad.

The hutch 12 includes a bottomless cabinet 36 having a rear wall 38, a top wall 40, first and second opposing side walls 42, 44, and a front opening 46 defined by the top and side walls or trim pieces associated therewith. A decorative trim piece 48 may be provided at the top portion of the hutch or elsewhere if desired. While the hutch could include one or more compartments having doors or drawers, such features increase the weight of the hutch and prevent direct access through the front opening. All compartments are accordingly directly accessible through the front opening in the preferred embodiment of the hutch. As the hutch is to be mounted to a chest 14 as described above, the first side wall 42 is greater in length than the second side wall 44. The rear wall 38 includes a notched portion at one end to accommodate the second section of the chest. When mounted to the chest, the bottom ends of the first and second side walls adjoin and are supported by the first and second top surfaces 30, 34, respectively. The rear wall has a first bottom surface 49A adjoining the first top surface 30, a second bottom surface 49B adjoining the second top surface 34, and a connecting surface 50 adjoining the inner side of the second section 18.

The rear and side walls of the hutch are preferably comprised of panels secured to elongate supports. The supports are preferably made from wood, while the panels can be plywood, particle board, or any other suitable material. A rigid structure can accordingly be provided which is not excessive in weight. One such support 52 extends between or substantially between the first bottom surface 49A and the top wall 40. A hole 54 extends through this support. A second hole 56 is preferably provided in the panel portion of the rear wall just above the lower support. This opening may be used to receive a wire plug 58. A lamp may accordingly be mounted to the second top surface such that the wire therefrom extends through the second hole 56.

Figure 3:
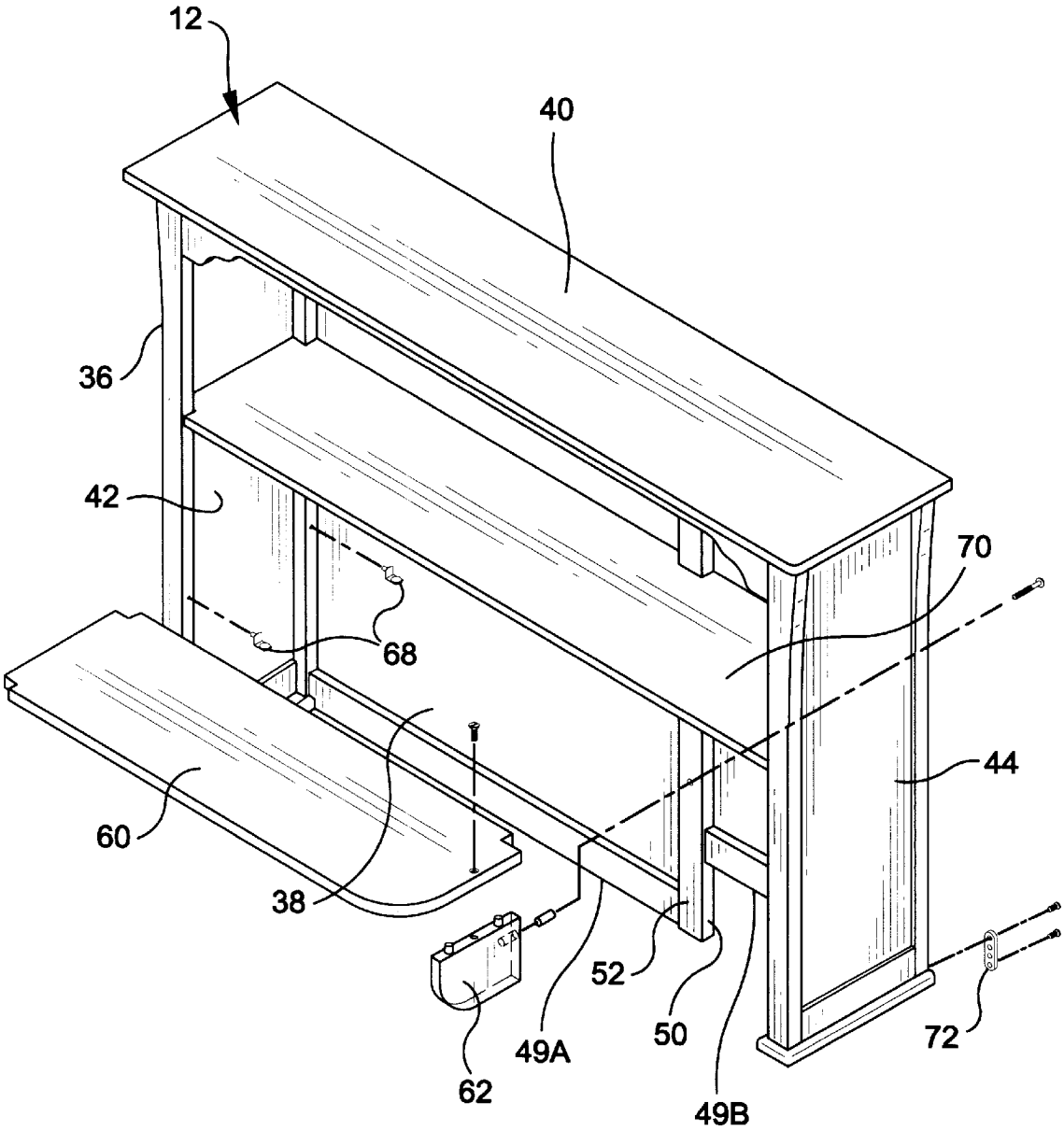
FIG. 3 is an exploded, top perspective view of a hutch in accordance with the invention.
Figure 5:
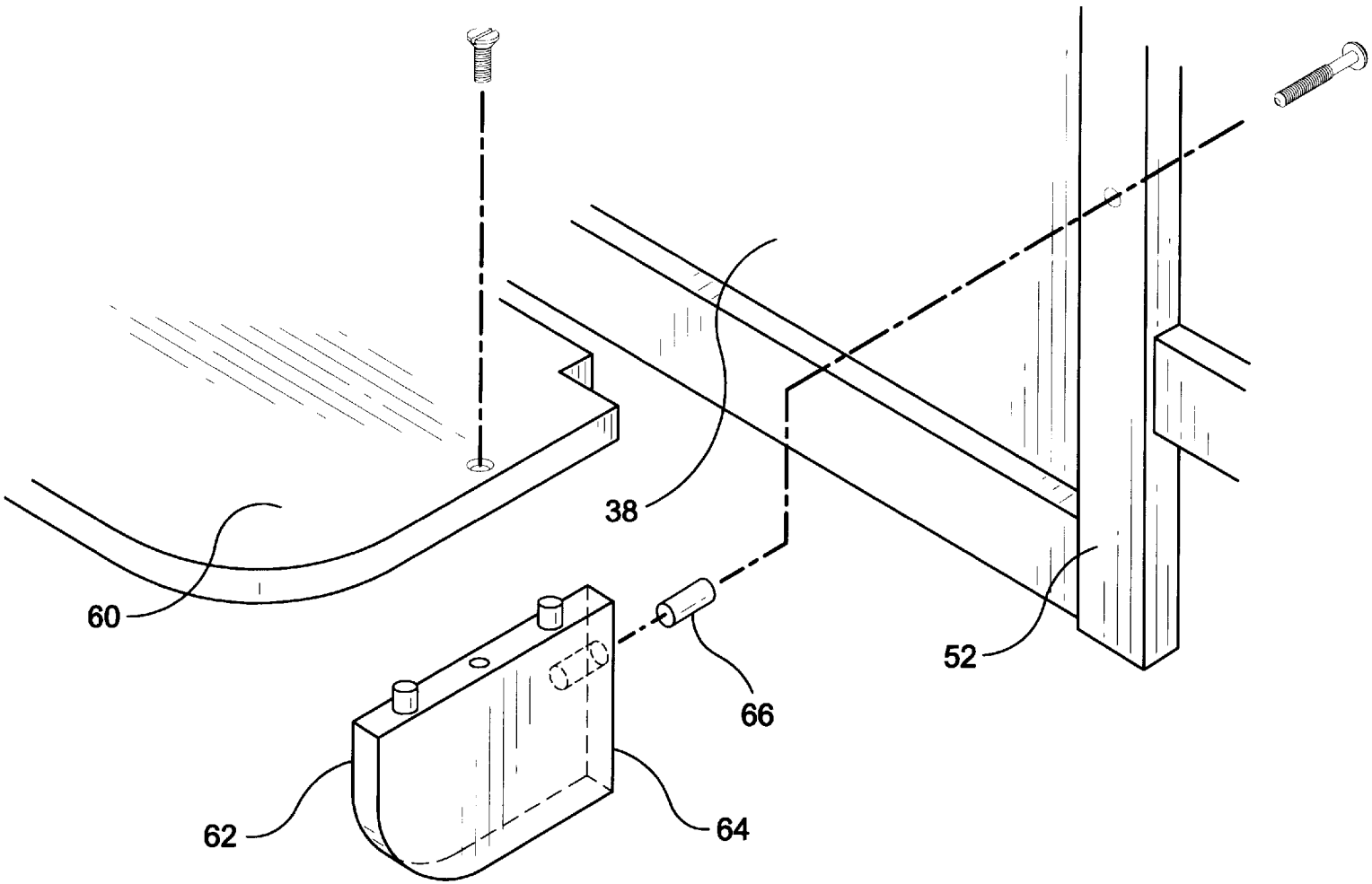
FIG. 5 is an enlarged, top perspective view showing a second end of the removable shelf and a shelf support therefor.
Figure 6:
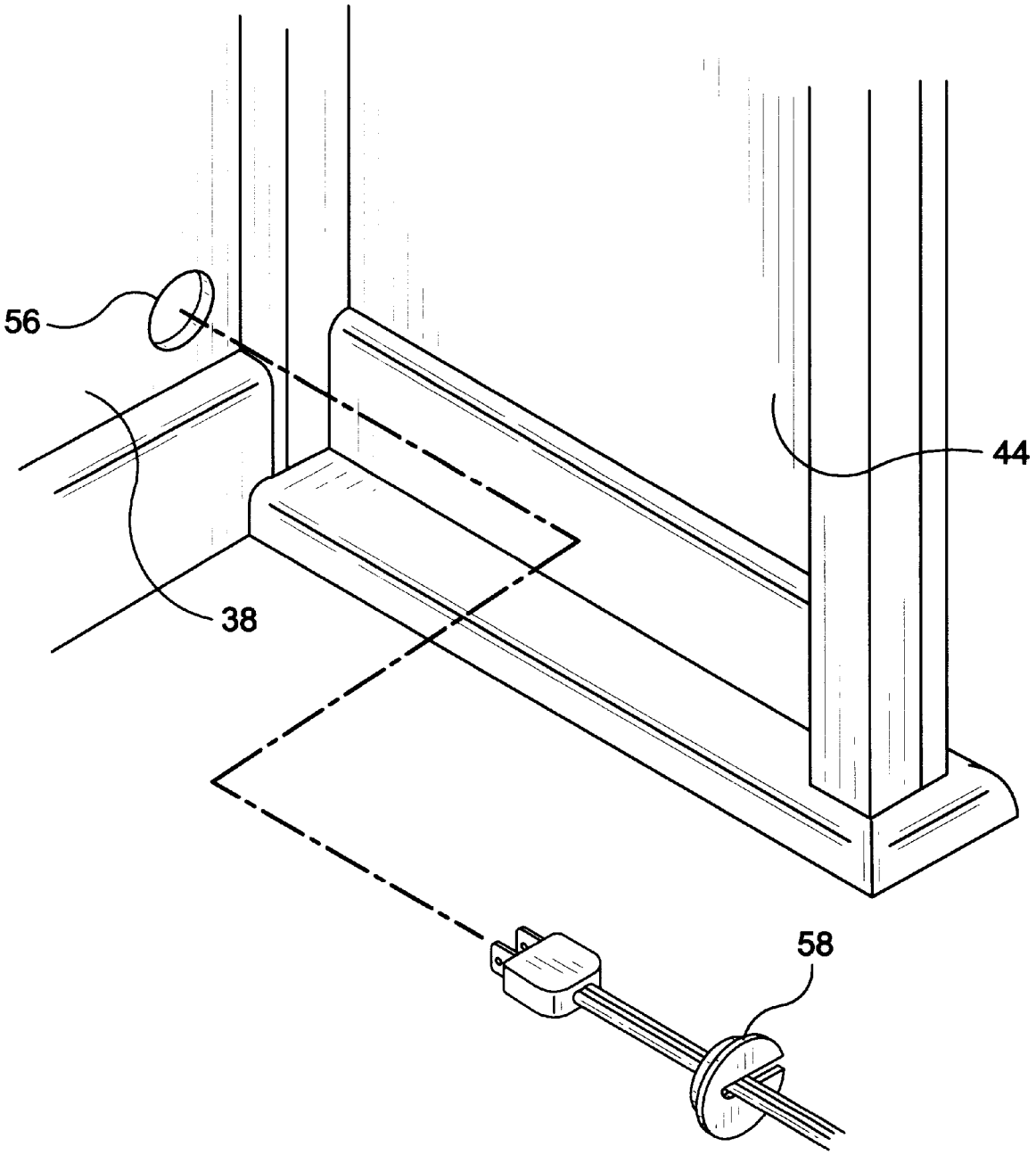
FIG. 6 is an enlarged top perspective view showing a portion of the hutch and an electrical cord.

A removable shelf 60 is provided as part of the hutch to consumers. The shelf 60 has a length which is substantially equal to the distance between the first side wall 42 of the hutch and the connecting surface 50. This distance is substantially the same as the width of the first section 16 of the chest 14. The shelf 60 is notched at three comers to accommodate the hutch supports, and is preferably rounded at the only exposed corner. A shelf support 62 is coupled to the shelf 60 by a screw and/or dowels as shown in FIGS. 3 and 5. Other types of connections known to the furniture industry could also be employed.

Figure 4:
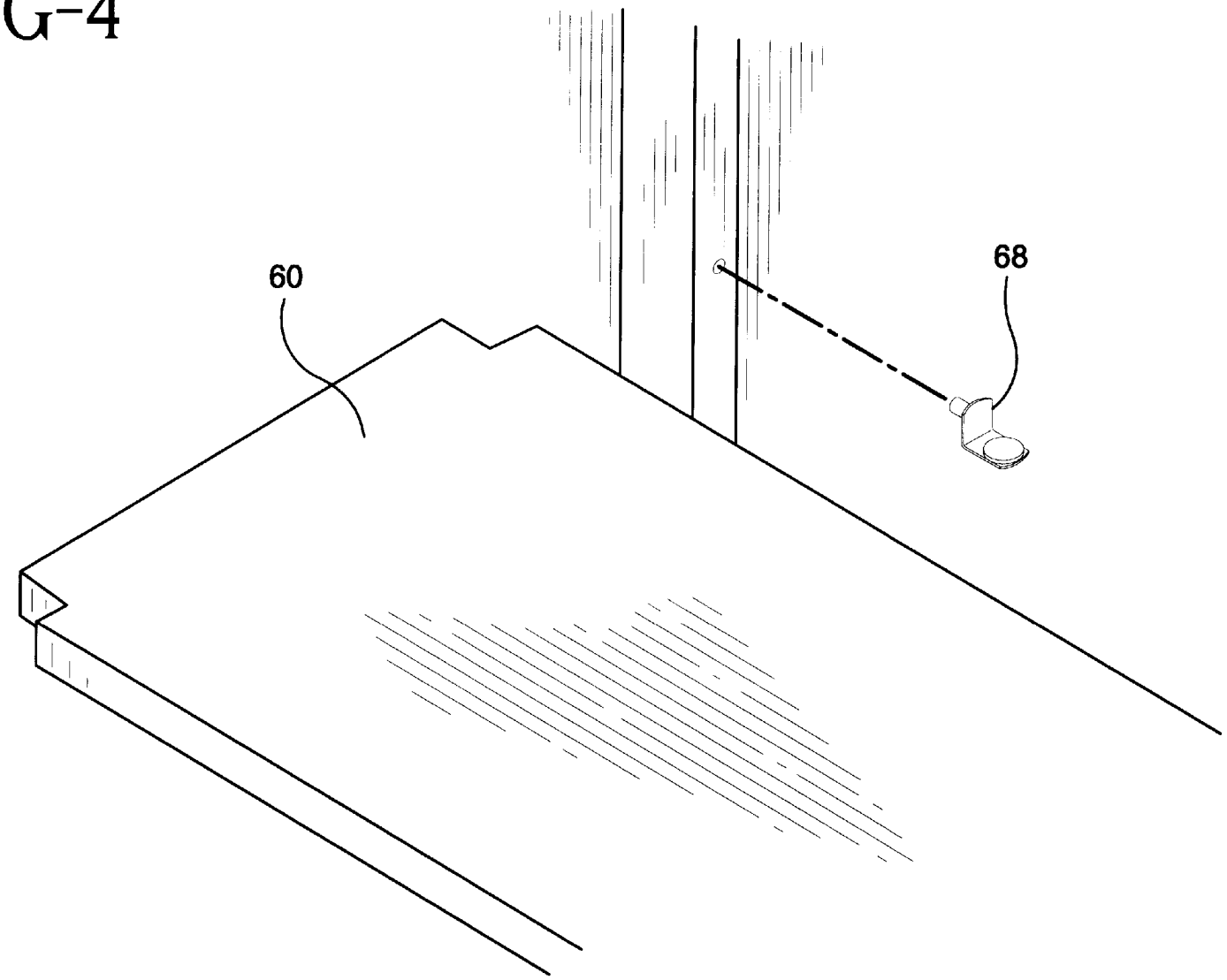
FIG. 4 is an enlarged, top perspective view showing one end of a removable shelf and a portion of a hutch.

The shelf support 62 includes a flat rear surface 64 having a threaded sleeve 66 extending therein. The sleeve 66 is alignable with the hole 54 in the vertical support 52. The shelf support can accordingly be removably coupled to the rear wall of the hutch by a screw. The end of the shelf 60 opposite from the shelf support 62 is supported by a pair of L-brackets 68 removably coupled to supports defining the front and rear ends of the first side wall 42, as best shown in FIGS. 3 and 4. While other means of supporting the shelf could be employed, a shelf support of the type shown is preferred as it forms a partition separating compartments of the hutch. The front edge of the shelf support is preferably rounded, as shown in FIG. 5.

The hutch according to the invention preferably includes a second shelf 70 which is intended for permanent usage. The second shelf is positioned above the first shelf 60, and is coupled to the cabinet in any known manner. In the preferred embodiment of the invention, the cabinet, shelves and shelf support are all comprised of wood.

The hutch 12 as used with the chest 14 provides a desirable arrangement of compartments which can be adjusted to meet different needs. If purchased by a consumer with a newborn child, the hutch 12 is mounted to the chest 14 without using the removable shelf 60. Plates 72, as shown in FIG. 3, are secured to the back portions of the chest and hutch to safely couple the two main elements of the assembly 10. The changing pad 32 is then removably secured to the chest such that one end thereof adjoins the first side wall 42 of the hutch while the other end adjoins the side of the second section 18 of the chest. This arrangement is shown in FIG. 2. Two large compartments are formed by the chest and hutch. One is bounded by the changing pad and second top surface 34 on its bottom and the second shelf at it supper end. Sufficient room is provided for changing a baby on the changing pad. A second compartment is provided above the second shelf.

Once a baby has outgrown the changing pad, the pad is removed and replaced by the shelf and shelf supports 60, 62, 68, as shown in FIG. 1. Three compartments are thereby formed below the second shelf. One horizontally elongate compartment is formed between the first side wall 42 and the wood shelf support 62. A second horizontally elongate compartment is formed between the two shelves 60, 70. A third, vertically elongate compartment is bounded by the second top surface 34, the upper shelf 70, the shelf support 62, and the second side wall 44. The arrangements of compartments made possible by the invention provide superior functionality for the consumer as a child matures.

It will be appreciated that modifications can be made to the chest and hutch for stylistic or other such purposes without departing from the spirit of the invention disclosed herein. The use of alternative materials and connectors known to the furniture industry is also possible. It should accordingly be understood that the description herein is intended to be illustrative only and is not intended to be limitative.

What is claimed is:

1. A hutch comprising:

a cabinet including a rear wall, a top wall, first and second opposing side walls defining first and second exterior cabinet surfaces, a bottom opening, and a front opening, said first side wall having a greater length than said second side wall; said rear wall having a first relatively wide horizontal bottom surface substantially coplanar with a bottom surface of said first side wall, a second, relatively narrow bottom surface substantially coplanar with a bottom surface of said second side wall, and a vertical connecting surface between said first and second bottom surfaces, and a first shelf removably mountable to said cabinet, said first shelf having a length substantially equal to the distance between said first side wall and said connecting surface.

2. A hutch as described in claim 1, including a second shelf mounted to said cabinet and extending between said first and second opposing side walls.

3. A hutch as described in claim 2, including a first shelf support coupled to said first shelf, said first shelf support including an end surface and a bore extending into said first shelf support through said end surface, said rear wall of said hutch including an opening extending therethrough and located beneath said second shelf, said opening being alignable with said bore.

4. A hutch as described in claim 3, including a second shelf support mountable to said first side wall and including a support surface engageable with said first shelf.

5. A hutch as described in claim 3 wherein said first shelf and first shelf support are both comprised of wood.

6. A hutch as described in claim 5 wherein said bore includes a threaded sleeve.

7. A hutch as described in claim 1, including means for securing said cabinet to a chest.

8. A hutch assembly comprising:

a chest including a first section including a plurality of storage compartments and a second section adjoining first said section, said second section including one or more storage compartments, said second section being greater in height than said first section, said first section being wider than said second section, said first section including a first top surface and said second section including a second top surface;

a hutch mounted to said chest, said hutch including a cabinet having a rear wall, a top wall, first and second side walls defining first and second exterior surfaces, and a front opening, said first side wall having a greater length than said second side wall and having a first bottom end adjoining said first top surface of said chest, said second side wall having a second bottom end adjoining said second top surface of said chest; said rear wall having a first horizontal bottom surface adjoining said first top surface of said chest, a second horizontal bottom surface adjoining said second top surface of said chest, and a vertical connecting surface adjoining a side of said second section of said chest and extending between said first and second bottom surfaces of said rear wall, and a first shelf removably mountable to said cabinet and having a length substantially equal to the width of said first section of said chest.

9. An assembly as described in claim 8 including a second shelf mounted to said cabinet and extending between said first and second side walls.

10. An assembly as described in claim 9 wherein said first shelf is mounted to said cabinet and positioned between said top surface of said first section and said second shelf, said first shelf adjoining said first side wall of said cabinet.

11. An assembly as described in claim 10, including a first shelf support coupled to said first shelf and to said rear wall of said cabinet.

12. An assembly as described in claim 11 wherein said rear wall of said cabinet includes at least one panel and a vertical support column secured to said panel, said first shelf support being secured to said support column.

13. An assembly as described in claim 12 wherein said vertical support column extends substantially between said top wall and said first bottom surface of said rear wall and defines said connecting surface.

14. An assembly as described in claim 8 including a changing pad removably secured to said first top surface.

15. An assembly as described in claim 14 wherein said changing pad extends substantially between said first side wall of said cabinet and a side of said second section of said chest.

16. An assembly as described in claim 8, including a first shelf support mounted to said first shelf and extending perpendicularly therefrom, a threaded sleeve mounted to said shelf support, a first opening above said first top surface of said first section of said chest extending through said rear wall of said cabinet and alignable with said threaded sleeve, and a second opening in said rear wall directly above said second top surface of said second section of said chest.

17. A hutch and chest assembly comprising:

a chest including a first section including a plurality of drawers and a second section including one or more storage compartments, said second portion being greater in height and lesser in width than said first section, said first section including a first top surface and said second section including a second top surface;

a hutch mounted to said chest, said hutch including a cabinet having a rear wall, a top wall, first and second opposing side walls, and a front opening, said first side wall being supported by said first top surface and having a greater length than said second side wall, said second side wall being supported by said second top surface, said rear wall having first and second bottom surfaces adjoining said first and second top surfaces, respectively;

a first shelf removably mounted to said cabinet above and parallel to said first top surface and having a length approximating the width of said first section, said first shelf including one edge adjoining said first side wall such that said first top surface and said first shelf define a first, horizontally elongated compartment, a second, horizontally elongated compartment is defined between said first shelf and a first elongate surface extending parallel to said first shelf, and a third, vertically elongate compartment is defined between said second top surface and a second elongate surface in opposing, parallel relation to said second top surface.

18. An assembly as described in claim 17 wherein said first and second elongate surfaces are defined by a second shelf coupled to said cabinet and extending between said first and second side walls.

19. An assembly as described in claim 17 wherein said rear wall includes an elongate support extending between said first bottom surface and said top wall, said first shelf being coupled to said elongate support.

20. An assembly as described in claim 17, including a shelf support coupled to said first shelf and to said rear wall, said shelf support including a vertical extending wall opposing said second wall of said cabinet and bordering said third, vertically elongate compartment.

21. A hutch comprising:

a cabinet including a rear wall, a top wall, first and second opposing side walls, a bottom opening, and a front opening, said first side wall having a greater length than said second side wall; said rear wall having a first horizontal bottom surface substantially coplanar with a bottom surface of said first side wall, a second horizontal bottom surface substantially coplanar with a bottom surface of said second side wall, and a vertical connecting surface between said first and second bottom surfaces, said rear wall including at least one panel and a vertical support column extending substantially between said top wall and said first bottom surface of said rear wall and defining said connecting surface, and a first shelf removably mountable to said cabinet, said first shelf having a length substantially equal to the distance between said first side wall and said connecting surface.

22. A hutch as described in claim 21, including a first shelf support coupled to said first shelf, and means for coupling said first shelf support to said vertical support column.

23. A hutch as described in claim 22 including a second shelf mounted to said cabinet and extending between said first and second side walls.

24. A hutch and chest assembly comprising:

a chest including a first section including a plurality of storage compartments and a second section adjoining said first section, said second section including one or more storage compartments, said second section being greater in height than said first section, said first section being wider than said second section, said first section including a first top surface and said second section including a second top surface;

a hutch mounted to said chest, said hutch including a cabinet having a rear wall, a top wall, first and second side walls, and a front opening, said first side wall having a greater length than said second side wall and having a first bottom end adjoining said first top surface of said chest, said second side wall having a second bottom end adjoining said second top surface of said chest; said rear wall having a first horizontal bottom surface adjoining said first top surface of said chest, a second horizontal bottom surface adjoining said second top surface of said chest, a vertical connecting surface adjoining a side of said second section of said chest and extending between said first and second bottom surfaces of said rear wall, a first support beam extending substantially between said top wall and said first bottom surface, a second support beam extending between said first support beam and said second side wall of said cabinet, and a shelf support coupled to said first support beam, and a first shelf removably mountable to said cabinet and having a length substantially equal to the length of said first section of said chest, said first shelf being mounted to said shelf support.

* * * * *